US006418938B1

(12) United States Patent
Fleischhauer et al.

(10) Patent No.: US 6,418,938 B1
(45) Date of Patent: Jul. 16, 2002

(54) BRUSH CLEANING UNIT FOR THE HEATER FIXTURE OF A SMOKING DEVICE

(75) Inventors: Grier Fleischhauer, Midlothian; Brett Stevenson, Richmond, both of VA (US); Shodo Minagawa, Tokyo (JP); Mary Ellen Counts, Richmond, VA (US)

(73) Assignee: Philip Morris Incorporated, Richmond, VA (US)

( * ) Notice: Subject to any disclaimer, the term of this patent is extended or adjusted under 35 U.S.C. 154(b) by 0 days.

(21) Appl. No.: 09/528,102

(22) Filed: Mar. 17, 2000

Related U.S. Application Data

(63) Continuation-in-part of application No. 09/188,446, filed on Nov. 10, 1998, now Pat. No. 6,119,700.

(60) Provisional application No. 60/142,531, filed on Jul. 7, 1999, and provisional application No. 60/153,657, filed on Mar. 19, 1999.

(51) Int. Cl.[7] ..... A24F 3/02

(52) U.S. Cl. ..... 131/243; 131/244; 131/329

(58) Field of Search ..... 131/243, 244, 131/329

(56) References Cited

U.S. PATENT DOCUMENTS 575,066 A * 1/1897 Lippincott
1,644,574 A * 10/1927 Fitzgerald
2,164,856 A * 7/1939 Lyons et al.
2,480,167 A * 8/1949 Thomas
2,590,479 A * 3/1952 Thomas
5,035,796 A * 7/1991 Saylor et al.
5,388,594 A 2/1995 Counts et al.
5,505,214 A 4/1996 Collins et al.
5,530,225 A 6/1996 Hajaligol
5,591,368 A 1/1997 Fleischhauer et al.
5,878,752 A * 3/1999 Adams et al.
6,119,700 A * 9/2000 Fleischhauer et al.

* cited by examiner

*Primary Examiner*—Christopher A. Fiorilla
(74) *Attorney, Agent, or Firm*—Burns, Doane, Swecker & Mathis, LLP

(57) ABSTRACT

A brush cleaning unit for a heater fixture of a smoking device includes a holder such as a tube wherein the heater fixture can be washed with a liquid by a movable brush. The tube can include first and second ends, a portion of a key for cooperating with a corresponding portion of the key on the heater fixture for orienting the heater fixture, and an arrangement for preventing the brush from rotating. The brush can be arranged to be axially movable relative to the tube and the heater fixture attached thereto.

13 Claims, 12 Drawing Sheets

BRUSH CLEANING UNIT FOR THE HEATER FIXTURE OF A SMOKING DEVICE

RELATED APPLICATION

This application is a Continuation-In-Part of application Ser. No. 09/188,446, filed Nov. 10, 1998 now U.S. Pat. No. 6,119,700, and claims priority of Provisional Application No. 06/153,657, filed Mar. 19, 1999 and No. 60/142,531, filed Jul. 7, 1999, all of which are herein incorporated by reference.

The present application is related to U.S. patent application Ser. No. 09/188,446, filed Nov. 10, 1998, which is hereby incorporated by reference.

FIELD OF THE INVENTION

The invention relates to a cleaning unit for use with a component of a cigarette smoking system. More particularly, the invention relates to a cleaning unit which cleans the component via a brush apparatus.

BACKGROUND OF THE INVENTION

Commonly assigned U.S. Pat. Nos. 5,388,594; 5,505,214; 5,530,225; and 5,591,368 disclose various electrically powered smoking systems comprising electric lighters and cigarettes and are hereby expressly incorporated by reference. The systems provide smoking pleasure while significantly reducing side stream smoke and permitting the smoker to selectively suspend and reinitiate smoking. During operation of such smoking systems, condensate can collect on various parts of the heating fixture. In order to remove such condensates, the smoking device may include a heating component which is used to drive off such condensates. Even with such a heating component, it may not be possible to remove as much of the condensates as desired. Further, the smoking pleasure derived from the smoking system may be adversely affected by condensate build-up in areas which cannot be sufficiently heated to drive off the condensates.

Commonly assigned U.S. patent application Ser. No. 09/176,028 entitled, "Cleaning Unit for the Heater Fixture of a Smoking Device", inventors Joe Banyasz et al., filed Oct. 21, 1998, discloses several embodiments of cleaning units for spraying water on selected locations of a heater fixture to remove condensate, and is expressly incorporated by reference. A difficulty with these cleaning units is the need to have a sufficient supply of water, usually a conventional tap, to remove the condensate with running water over a period of time. These cleaning units are typically connected to the tap, and may not be able to be easily used if a standard tap is not available. It is desirable to provide a cleaning device that does not require a large amount of water to remove condensates from a heater fixture, and that need not be connected to a water supply tap.

SUMMARY OF THE INVENTION

According to one aspect of the present invention, a brush cleaning unit for a heater fixture of a smoking device includes a tube having a first end and a second end, the tube including a portion of a key for cooperating with a corresponding portion of the key on a heater fixture for attaching and orienting the heater fixture relative to the tube. The brush cleaning unit also includes a brush attached to the tube. The brush is axially movable relative to the tube and the heater fixture attached thereto. The brush is non-rotatable relative to the tube.

According to another aspect of the present invention, a method for cleaning a heater fixture of a smoking device is disclosed. According to the method, a heater fixture is attached to the second end of a tube having a first and a second end. An aqueous medium is supplied to the first end of the tube such that the aqueous medium flows through the tube and an opening in the heater fixture and out the second end of the tube. A bristled portion of a brush, the brush having a handle disposed in and axially movable relative to an opening through a wall of the tube, is moved through the opening in the heater fixture.

According to one aspect of the present invention, a brush cleaning unit for a heater fixture of a smoking system includes a tube having a first end and a second end, the tube including a portion of a key for cooperating with a corresponding portion of the key on a heater fixture for attaching and orienting the heater fixture relative to the tube. The brush cleaning unit also includes a brush attached to the tube. The brush is axially movable relative to the tube and the heater fixture attached thereto. The brush is non-rotatable relative to the tube.

According to another aspect of the present invention, a method for cleaning a heater fixture of a smoking system is disclosed. According to the method, a heater fixture is attached to the second end of a tube having a first and a second end. An aqueous medium is supplied to the first end of the tube such that the aqueous medium flows through the tube and an opening in the heater fixture and out the second end of the tube. A bristled portion of a brush, the brush having a handle disposed in and axially movable relative to an opening through a wall of the tube, is moved through the opening in the heater fixture.

According to one aspect of the present invention, a brush cleaning unit includes a tube having a first end and a second end, the tube including a heater fixture receiving portion, the tube including a radial opening for ingress of cleaning fluid to the tube. The brush cleaning unit further includes a brush attached to the tube and axially movable relative to the tube. The brush cleaning unit further includes a fluid reservoir having an open first end detachably connectable to the opening of the tube, the fluid reservoir being detachably connectable to the heater fixture receiving portion.

According to yet another embodiment of the present invention, a brush cleaning unit includes a tube having a first end and a second end, the tube including a heater fixture receiving portion between the first end and the second end, the tube including an axial opening at the second end of the tube in fluid communication with the heater fixture receiving portion. A brush is attached to the first end of the tube and axially movable relative to the tube. A fluid container having an open first end detachably connectable to the second end of the tube around the axial opening of the tube and a closed second end.

According to still another embodiment of the present invention, a brush cleaning unit includes a cylinder having a first part and a second part, the first and second parts of the cylinder being detachably connected and defining an internal heater fixture receiving portion. A brush is attached to the first part of the cylinder and axially movable relative to the cylinder. The first part of the cylinder includes a movable door facilitating introduction of cleaning fluid to the heater fixture receiving portion.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF THE PREFERRED EMBODIMENTS

Figure 1:
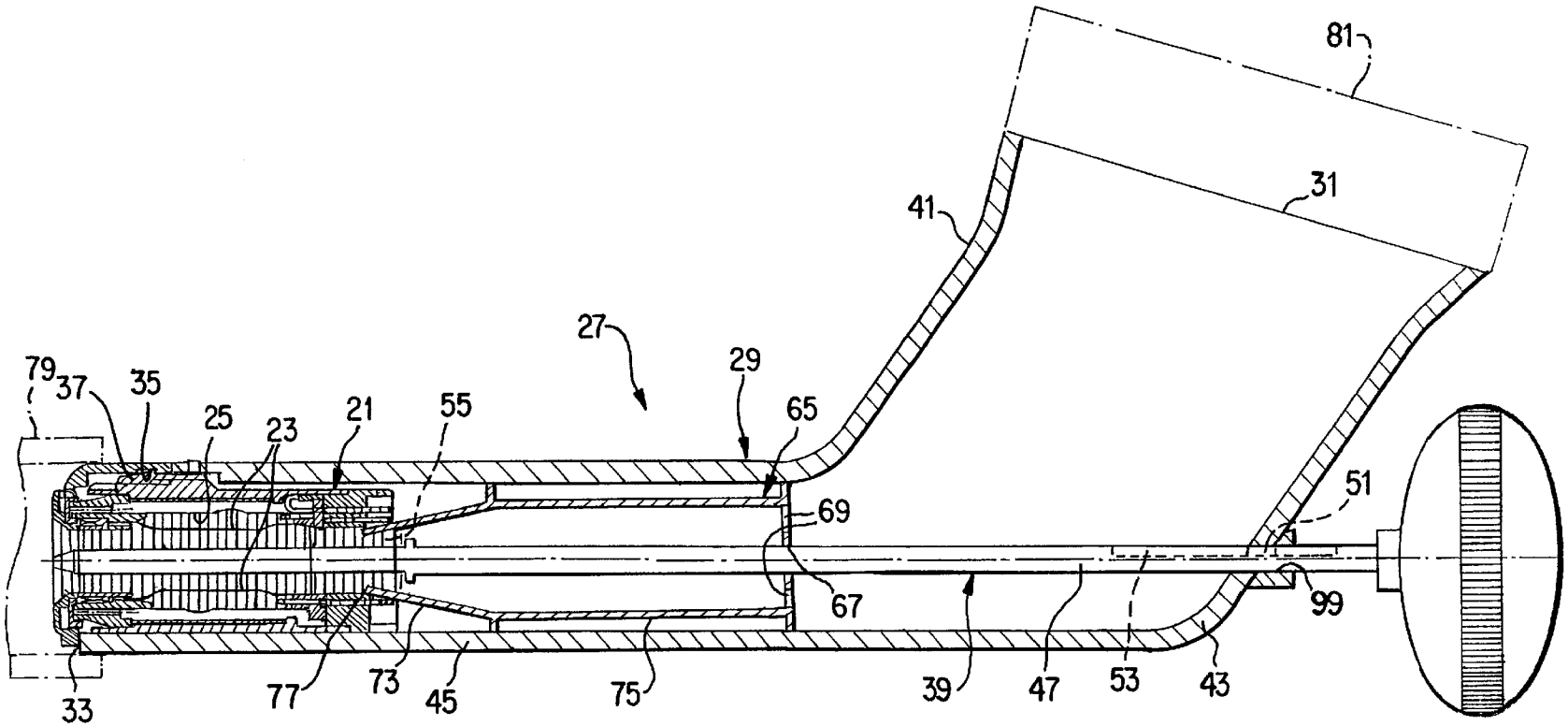
FIG. 1 is a schematic, cross-sectional side view of a brush cleaning unit according to an embodiment of the present invention.
Figure 5:
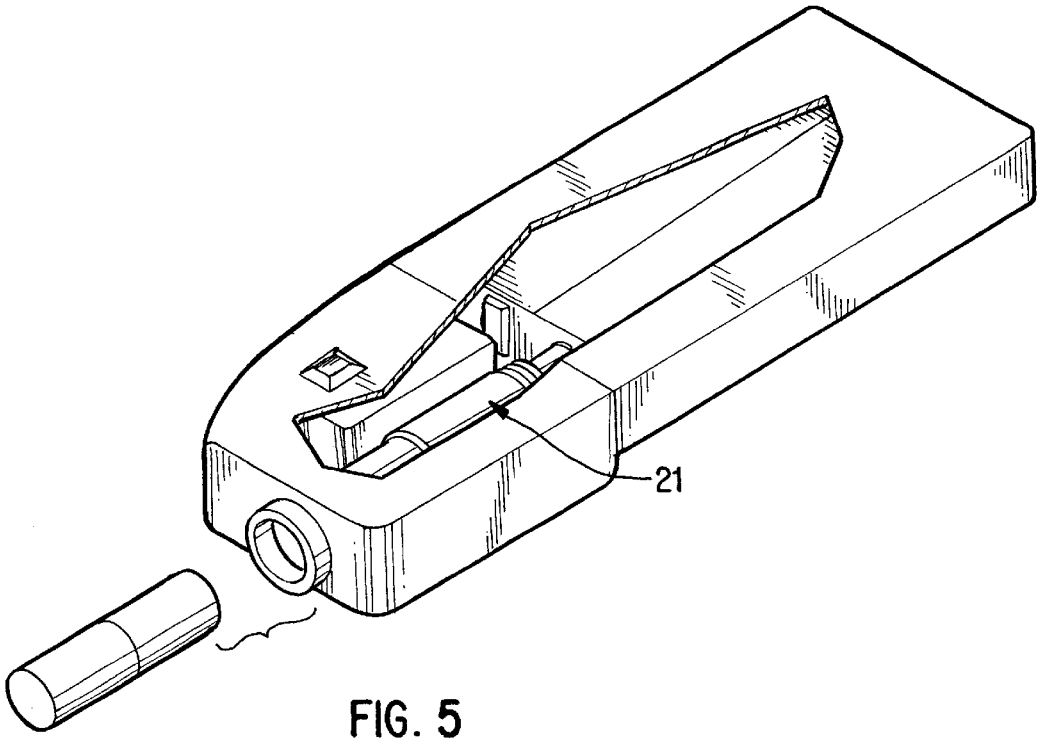
FIG. 5 is a schematic, perspective view of a smoking system according to an embodiment of the present invention.

U.S. Pat. Nos. 5,388,594; 5,505,214; 5,530,225; and 5,591,368 disclose various electrically powered smoking systems comprising electric lighters and cigarettes and are hereby expressly incorporated by reference. A smoking system representative of the type of smoking systems with which the present invention is usable is shown in FIG. 5. As seen in FIGS. 1 and 5, the electric lighters or heating fixtures of these smoking systems are typically tubular elements 21 with two open ends. As seen in FIG. 1, a plurality of mutually parallel, longitudinal heater blades 23 are arranged along an interior periphery of the tube and, in use, contact a specially adapted cigarette to heat the cigarette. The heater blades 23 are surrounded by a cylindrical can 25. During smoking, condensates can build up on the can 25 and the blades 23. Portions of the blades 23 are heated to very high temperatures so that some condensates adjacent the blades are sometimes charred. Condensates on the tips of the heater blades 23 are less easily removed. It has been determined that it is desirable to periodically clean the heater fixture to remove condensates from the heater blades 23, the can 25, and adjacent portions of the tube 21.

A brush cleaning unit 27 according to an embodiment of the present invention is shown in FIG. 1. The unit 27 includes a tube 29 having a first end 31 and a second end 33. The tube 29 includes a portion 35 of a key for cooperating with a corresponding portion 37 of the key on the heater fixture 21 for attaching and orienting the heater fixture relative to the tube.

Presently preferred heater fixtures 21 have retractable pins or prongs for securing the heater fixture to a power supply and control portion of the electrical smoking system by mating with a corresponding opening in the power supply and control portion. It is preferred that such a retractable pin or prong forms the corresponding portion 37 of the key and that the portion 35 of the key is in the form of a pin or prong receiving opening in the tube 29. The key formed by the portion 35 and the corresponding portion 37 preferably prevents axial or rotational movement of the heater fixture 21 when the portion and the corresponding portion mate. If desired or necessary, the key may prevent only rotational movement, and another structure, such as a compression fit between the heater fixture 21 and the tube 29 or an O-ring (not shown) disposed in a groove (not shown) inside of the tube, may be provided to prevent or limit axial movement.

In addition to the tube 29, the brush cleaning unit 27 includes a brush 39 attached to the tube and axially movable relative to the tube and the heater fixture attached thereto. The brush 39 is non-rotatable relative to the tube.

The tube 29 preferably includes a first straight length 41 extending from the first end 31 to a bent portion 43, and a second straight length 45 extending from the bent portion to the second end 33. The straight lengths 41 and 45 are preferably straight in the sense that they are substantially symmetrical about a straight axis. As seen in FIG. 1, the first end 31 preferably has a larger inside dimension $D_1$ than the inside dimension $D_b$ of the bent portion 43 and is preferably funnel-shaped to facilitate introduction of an aqueous medium, such as water, into the first end of the tube 29.

The brush 39 preferably includes a handle portion 47 extending from outside of the tube 29 through an opening 49 in the bent portion 43 to inside of the second straight length 45. The handle portion 47 and the opening 49 are preferably non-circular, such as by being triangular, square, pentagonal, etc., and/or by virtue of being formed with a second key 51 and a receptacle 53 for the second key in which the second key is axially movable, such as an otherwise circular handle with a key or key receptacle extending along its length or a portion of its length.

A plurality of bristles 55 are preferably attached to the handle 47 and arranged in a plurality of longitudinal rows corresponding to locations of spaces between longitudinally arranged heater elements or blades 23 in the heater fixture.

More particularly, the bristles 55 are preferably arranged in rows to fit between the heater blades 23 so that the bristles impinge upon the can 25 without contacting the delicate blades. Because the brush 39 is non-rotatable relative to the tube 29, if the heater fixture 21 is also non-rotatable relative to the tube, the possibility of damage to the blades 23 from contact with the bristles 55 is reduced and the life of the heater fixture is prolonged.

Figure 2:
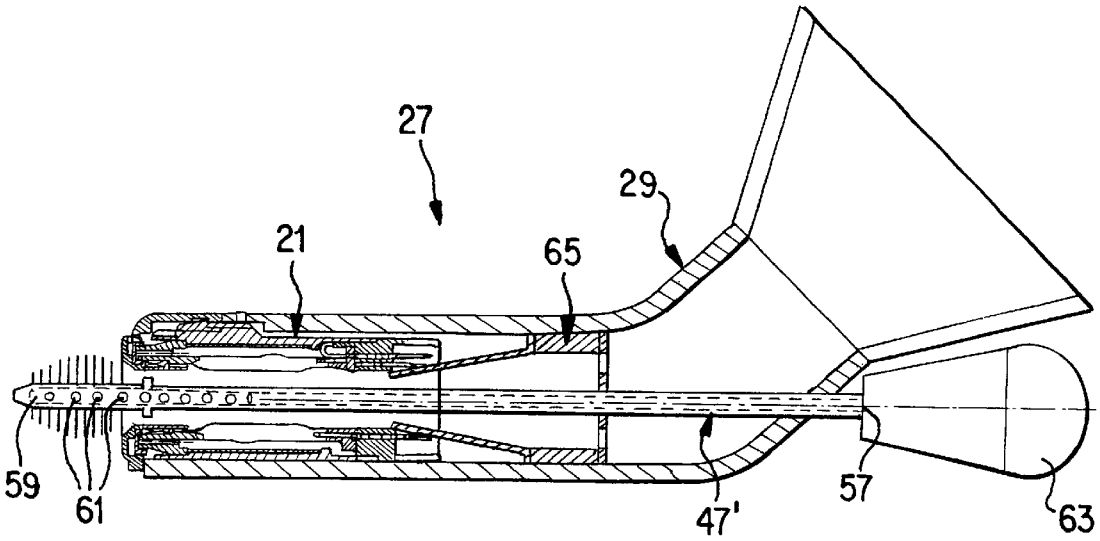
FIG. 2 is a schematic, cross-sectional side view of a brush cleaning unit according to an embodiment of the present invention.

As seen in a second embodiment shown in FIG. 2, the handle 47' may be hollow and having an open end 57 and a closed end 59. The open end 57 is disposed outside of the tube 29 and the closed end 59 is disposed inside of the tube or outside of the tube downstream from the second end 33. The handle 47' preferably has a plurality of radial openings 61 proximate the closed end 59. The open end 57 is preferably attached to an aqueous medium supply source, such as a tube connected to a faucet, or a compressible bulb 63 attached to the open end of the handle. The closed end 59 of the handle 47' may be in the form of the spray head disclosed in commonly-assigned U.S. patent application Ser. No. 09/176,028, entitled "Cleaning Unit for the Heater Fixture of a Smoking Device", Inventors Joe Banyasz et al., filed Oct. 21, 1998, which is expressly incorporated by reference. Aqueous medium is preferably forced under pressure from the open end 57 through the radial openings 61 to impinge against the can 25 and further assist in removing condensates.

Figure 3:
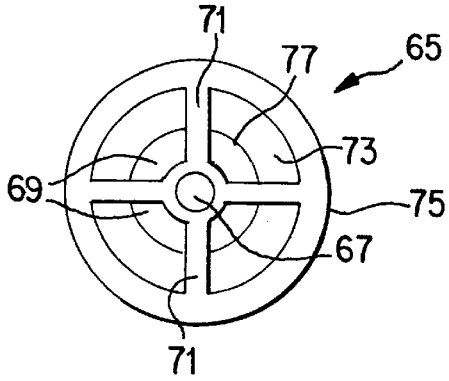
FIG. 3 is a front view of a support for a brush cleaning unit according to an embodiment of the present invention.
Figure 4:
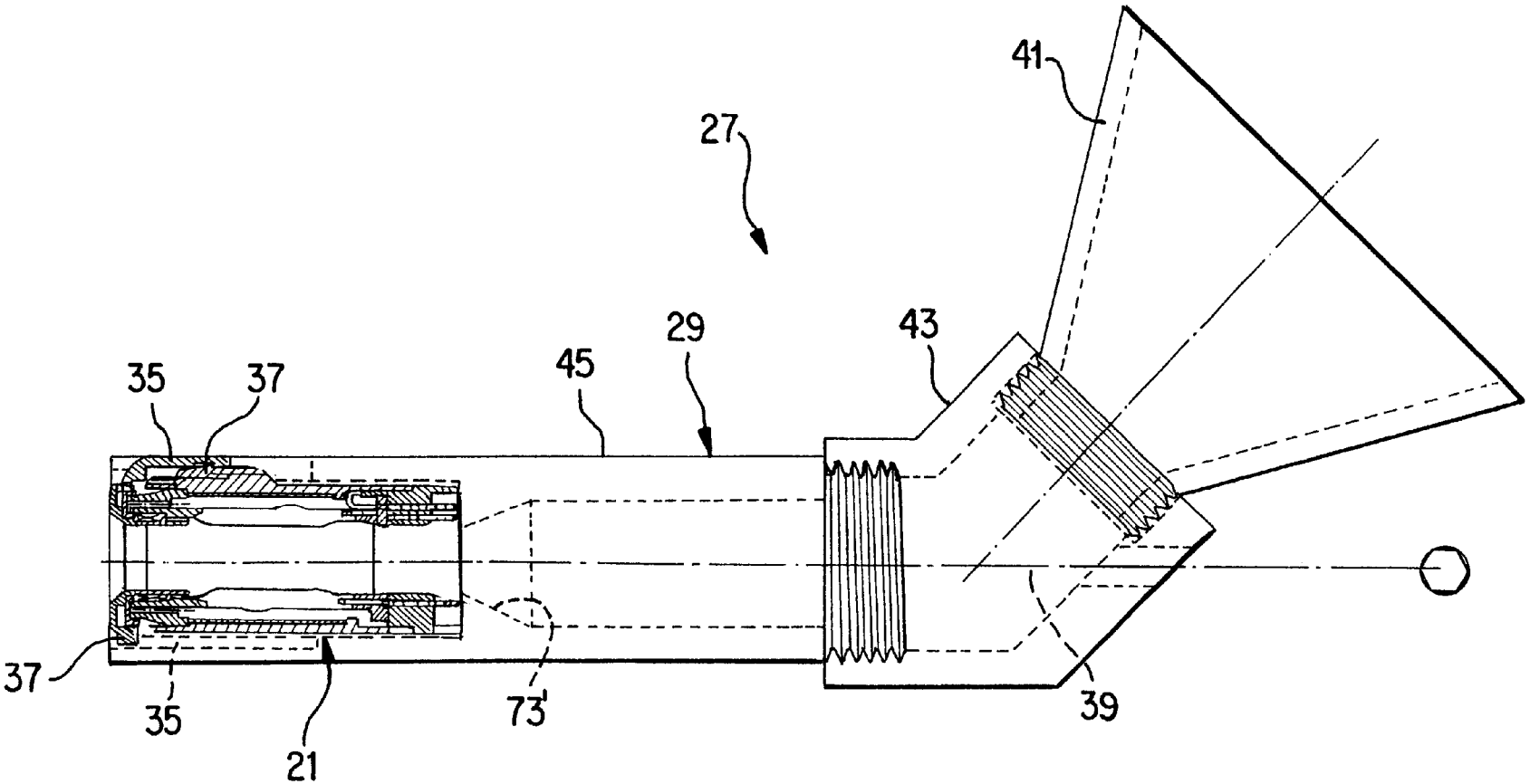
FIG. 4 is a schematic, cross-sectional side view of a brush cleaning unit according to an embodiment of the present invention.

As seen in FIGS. 1 and 2, a support 65 is preferably disposed inside of the tube 29. As seen in FIG. 3, the support 65 preferably has a central opening 67. The support 65 preferably has at least one, preferably plural second openings 69 disposed radially outside of the central opening 67, and the support is preferably in the form of a wagon wheel shape, with a plurality of radially extending spokes 71 extending outwardly from the central opening. As seen in FIGS. 1 and 2, the brush 39 extends through the central opening 67. The support 65 preferably also includes a shield 73 extending in a longitudinal direction of the tube 29 from a main body portion 75 of the support toward the second end 33 of the tube, i.e., in a downstream direction. The shield 73 is preferably in the form of a truncated cone that narrows toward the second end of the tube to a narrow end 77, and the narrow end is preferably narrower than an inside dimension of the heater fixture 21. Preferably, the inside dimension of the heater fixture 21 is in contact with the outside dimension of the shield through a compression fit. Components of the heater fixture 21, such as prongs for electrically connecting the heater fixture to the power supply and control portion of the smoking system, are preferably protected against contact with aqueous medium flowing through the tube 29 by the shield 73. As seen in FIG. 4, if desired or necessary, the support 65 can be omitted entirely. If desired or necessary, a shield 73' can be provided in the absence of a support by forming an inside dimension of the second straight length 45 to narrow as it approaches a rear end of the heater fixture 21. As also seen in FIG. 4, the tube 29 can be formed in a plurality of pieces, such as a separate first straight length 41, second straight length 45, and bent portion 43, and the separate components may be joined together, such as by suitable internal and external threads, adhesive, or the like.

When the heater fixture 21 is positioned relative to the second straight length 45 of the tube 29, a flexible tube 79 is preferably attached to the second end 33 of the tube. The flexible tube 79 facilitates directing the aqueous medium that flows through the tube 29 directly to a drain to the convenience of a user.

Ordinarily, aqueous medium such as water is introduced to the tube 29 through the funnel-shape at the first end 31 of the tube. In addition to or instead of the funnel-shape at the first end 31 of the tube 29, a quick disconnect fitting 81 for attachment to a faucet may be attached to the first end of the tube, thereby minimizing the possibility of splashing of the aqueous medium during use.

In a method for cleaning a heater fixture of a smoking device according to the present invention, the heater fixture 21 is attached to the second end 33 of the tube 29. The heater fixture 21 may be disposed inside of the second straight length 45, partially inside of the second straight length as shown in FIGS. 1 and 2, or outside of the second straight length and fixed to the second end 33 of the tube.

An aqueous medium such as water is supplied to the first end 31 of the tube 29 such that the aqueous medium flows through the tube and an opening in the heater fixture 21 and out the second end 33 of the tube. The bristled portion 55 of the brush 39 that has the handle 47 disposed in and axially movable relative to the opening 49 through a wall of the tube 29 is moved through the opening in the heater fixture to impinge against condensate on the can 25. Because the brush 47 is preferably non-rotatable relative to the opening 49 through the wall of the tube 29 and the heater fixture 21 is preferably non-rotatable relative to the tube, the bristles 55 are preferably oriented in longitudinal rows so that they fit between the blades 23 of the heater fixture and impinge solely against the surface of the can 25. The handle 47 of the brush 39 is preferably also moved through the axial support 65 disposed in the tube. The flexible tube 79 is preferably attached to the second end 33 of the tube 29 and the aqueous medium flowing out of the second end of the tube is directed to a desired location such as a sink drain.

As disclosed in commonly-assigned U.S. Provisional Patent Application Ser. No. 09/188,416 entitled "Pump Cleaning Unit for the Heating Fixture of a Smoking Device" to Nichols et al., filed on Oct. 10, 1998, it has been learned that it is particularly advantageous to soak the heater fixture in the aqueous medium. The heater fixture is preferably soaked for about ten minutes, and the aqueous medium used for soaking is preferably about 100° F. to about 150° F., more preferably about 110° F. to about 130° F., and most preferably about 115° F.

The brush cleaning unit according to the present invention has been found to be able to perform at least a comparable cleaning job as the cleaning unit according to U.S. patent application Ser. No. 09/176,028 that preferably uses a source of running water while using only a fraction of the water used in that cleaning unit. Moreover, the pump cleaning unit according to the present invention can be used in virtually any setting where water can be provided, regardless of whether the tap to be used is a standard size fitting.

Figure 6:
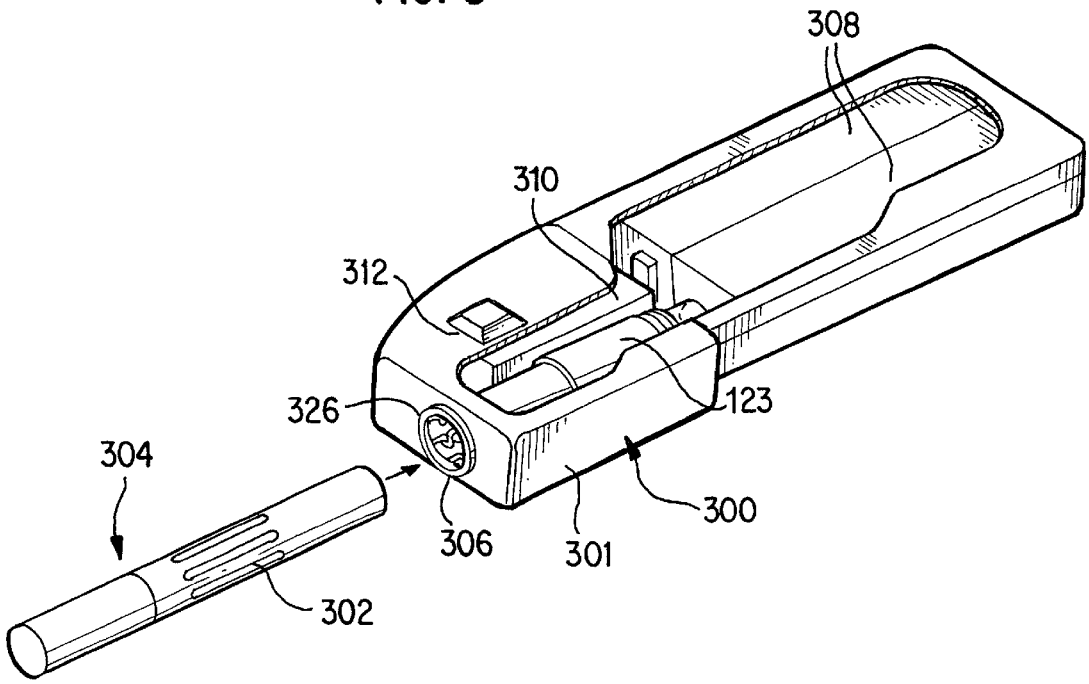
FIG. 6 is a perspective view of a smoking system for use with a brush cleaning unit according to the present invention.

FIG. 6 shows a lighter 301 and cigarette 304 of a smoking system 300. The lighter 301 includes a removable heater fixture 123. The heater fixture 123 includes heating elements which are electrically powered to heat a region 302 along a cigarette 304. The heater fixture 123 includes a cigarette receiving section 322, a terminal base 324, and a plurality of longitudinally extending heating elements 326. The cigarette 304 is smoked by inserting the cigarette 304 in an opening 305 of the lighter 301. The smoking system 300 includes batteries 308, a logic circuit 310, and a display 312 for indicating the number of puffs remaining to be smoked. During use of the smoking system 300, condensates from the cigarette smoke accumulate in the heater fixture 123. In order to clean the heater fixture 123, the heater fixture is removed from the smoking system 300 and placed in the holder of a cleaning unit according to the present invention.

Figure 7:
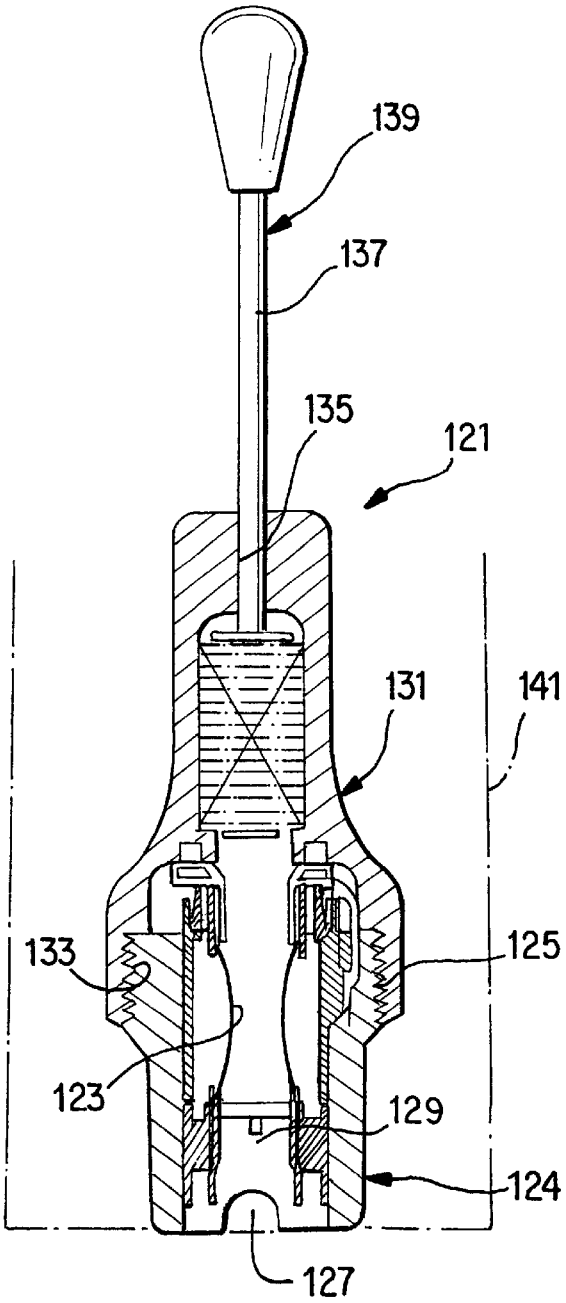
FIG. 7 is a schematic, cross-sectional side view of a brush cleaning unit according to an embodiment of the present invention.

An embodiment of a brush cleaning unit 121 is shown in FIG. 7. The brush cleaning unit 121 includes a bottom portion 124 that preferably includes an external thread 125 proximate a top end, a radial opening 127 proximate a bottom end, and an axial opening 129. The axial opening 129 preferably extends the length of the bottom portion 124 and has an asymmetrical shape that corresponds to the asymmetrical shape of the heater element 123 such that the heater element is prevented from rotation relative to the bottom portion. The bottom end of the bottom portion 124 may be closed axially but is preferably open.

The brush cleaning unit 121 also includes a top portion 131 having an internal thread 133 for mating with the external thread 125 and having an internal axial opening defining an upper portion of a cavity in which the heater element 123 is disposed. The top portion 131 also has an opening 135 through which a handle 137 of a brush 139 extends such that reciprocation of the brush in the opening causes bristles of the brush to contact the inner surface of the heater element to remove condensates. Preferably the shaft of the handle 137 is non-rotatable relative to the top portion 131, such as by having a non-circular cross-sectional shape, such as a key shape, that slides in a corresponding non-circular opening in the top portion.

Figure 8:
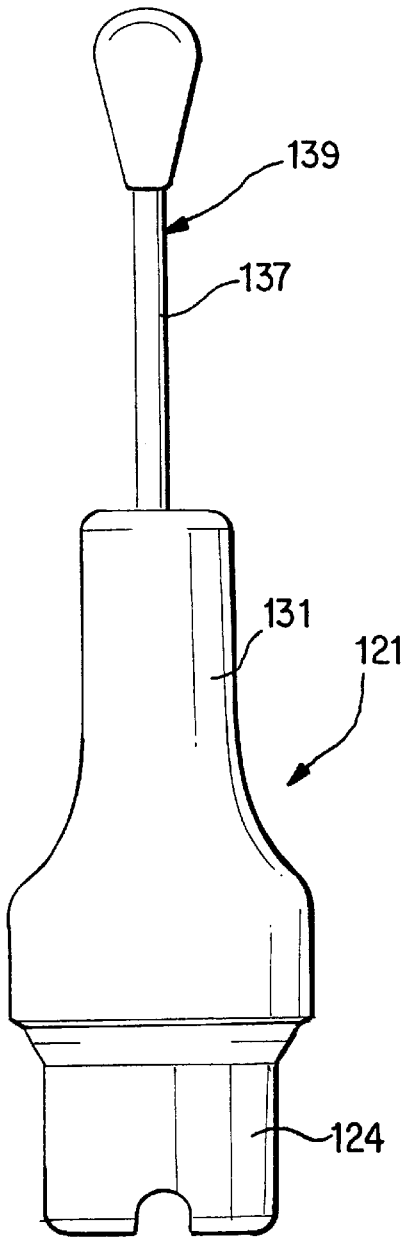
FIG. 8 is a side view of a brush cleaning unit according to an embodiment of the present invention.

The radial opening 127 in the bottom portion 124 of the brush cleaning unit 121 permits ingress and egress of cleaning fluid, such as water or soapy water, when the brush cleaning unit is partially or substantially immersed in water, such as in a glass or bowl 141 as illustrated in phantom in FIG. 7. The brush cleaning unit 121 is shown from the side in FIG. 8.

Figure 9:
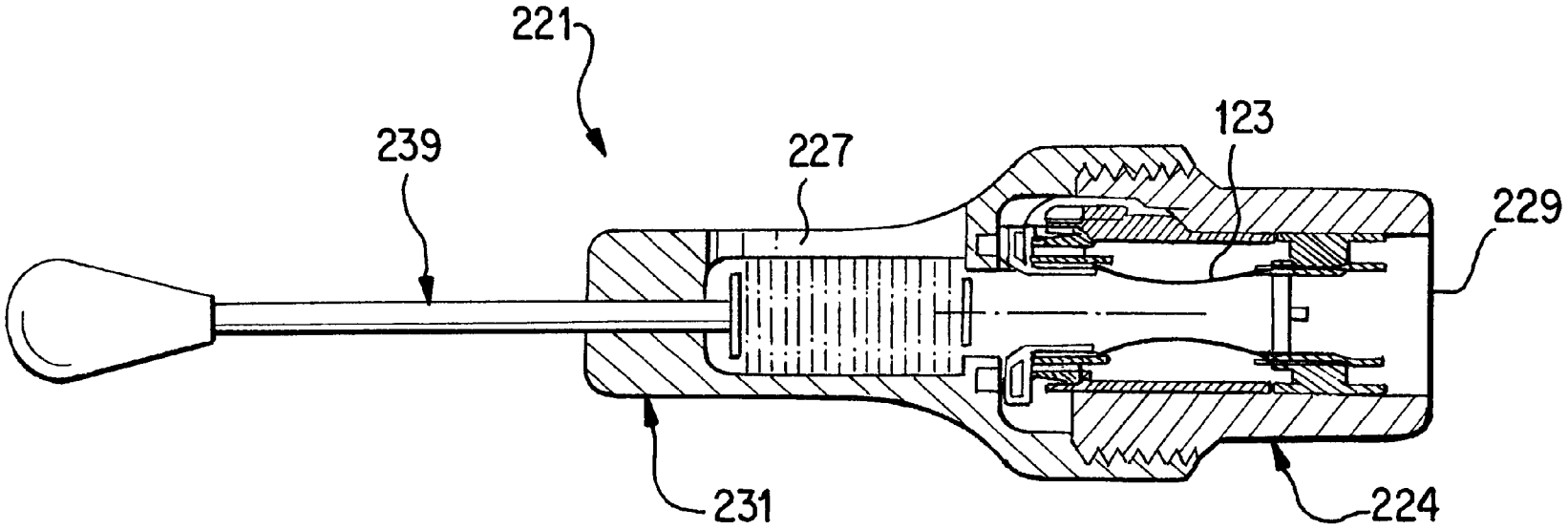
FIG. 9 is a schematic, cross-sectional side view of a brush cleaning unit according to an embodiment of the present invention.

Another embodiment of the brush cleaning unit 221 is shown in FIG. 9 and is similar to the brush cleaning unit 121 shown in FIG. 7. The brush cleaning unit 221 includes a radial opening 227 in the top portion 231 and preferably has an axial opening 229 extending to a bottom of the bottom portion 224. Cleaning fluid, such as water or soapy water, is preferably introduced to the brush cleaning unit 221 through the radial opening 227 as the brush cleaning unit is disposed horizontally, and flows out of the brush cleaning unit through the axial opening 229 at the bottom of the brush cleaning unit.

Figure 10:
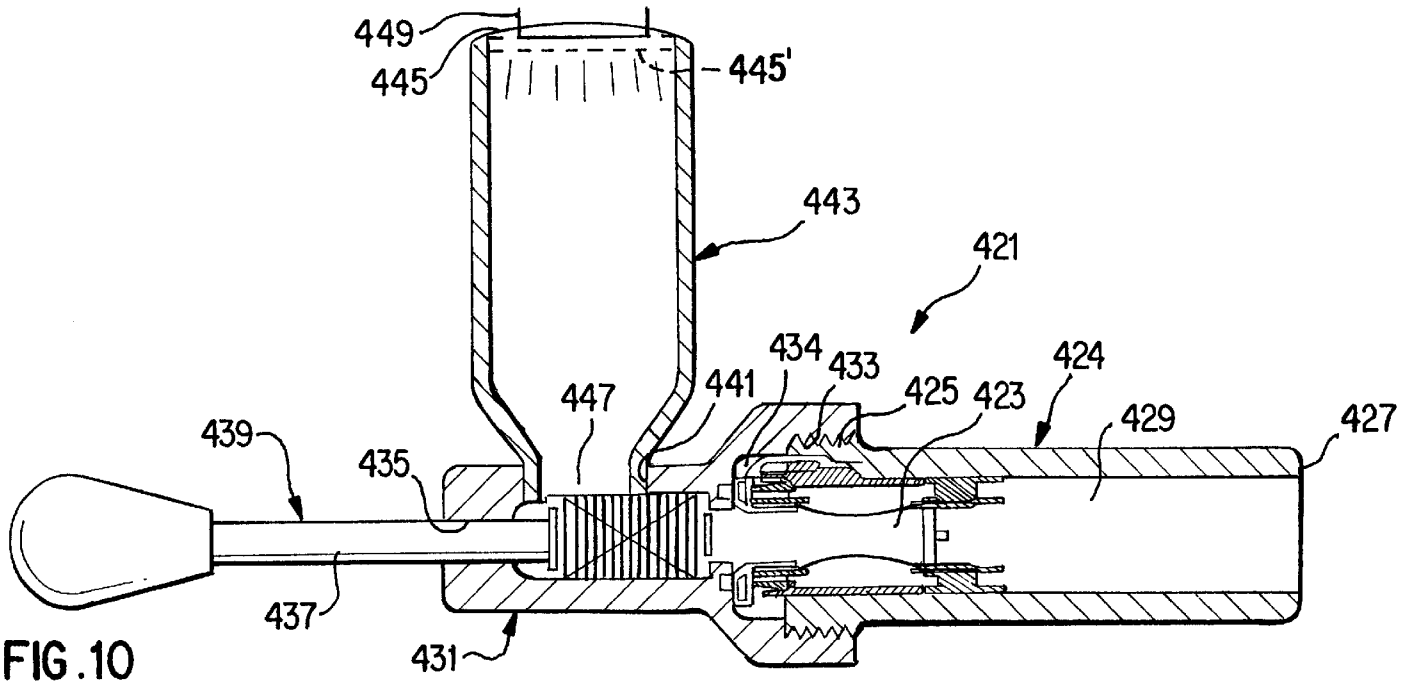
FIG. 10 is a partial cross-sectional side view of a brush cleaning unit according to an embodiment of the present invention.

An embodiment of another brush cleaning unit 421 in accordance with the invention is shown in FIG. 10. The brush cleaning unit 421 preferably includes a tubular bottom portion 424 that preferably includes an external thread 425 proximate a top end, a bottom end 427, and an axial opening 429. The axial opening 429 preferably extends the length of the bottom portion 424 and has an asymmetrical shape that corresponds to the asymmetrical shape of the heater element 423 such that the heater element is prevented from rotation relative to the bottom portion. The bottom end 427 of the bottom portion 424 may be closed axially but is preferably open.

The brush cleaning unit 421 also includes a top portion 431 having an internal thread 433 for mating with the external thread 425 and having an internal axial opening 434 defining an upper portion of a cavity in which the heater element 423 is disposed. The top portion 431 also has an opening 435 through which a handle 437 of a brush 439 extends such that reciprocation of the brush in the opening causes bristles of the brush to contact the inner surface of the heater element to remove condensates. Preferably the shaft of the handle 437 is non-rotatable relative to the top portion 431, such as by having a non-circular cross-sectional shape, such as a key shape, that slides in a corresponding non-circular opening in the top portion.

In the embodiment shown in FIG. 10, the top portion 431 also includes a radial opening 441 in which a reservoir 443, which may be in the form of a funnel having an open top end 445 and an open bottom end 447 and through which water from, for example, a tap 449, is introduced to the cleaning unit. An alternative form of the reservoir is a container having a closed, top end 445' and an open bottom end, as seen in phantom in FIG. 10 and which is filled with cleaning fluid before attachment to the radial opening 441. The attachment of the reservoir to the top portion 431 may be by any suitable means, such as by a threaded connection, a friction fit, or a snap connection. The reservoir 443 may include a frustoconical bottom end 447 as seen in FIG. 10 or may, if desired or necessary, be substantially circularly cylindrical along its entire length. The reservoir 443 and the bottom portion 424 are preferably shaped such that, when the cleaning unit is not in use, the reservoir is detachable from the radial opening 441 and is slid over the bottom portion 424. The reservoir 443 may be secured to the bottom portion 424 by any suitable means, such as a threaded connection, a friction fit, or a snap fit.

In the embodiment shown in FIG. 10, the bottom end 427 in the bottom portion 424 of the brush cleaning unit 421 permits egress of cleaning fluid, such as water or soapy water, when cleaning fluid is introduced through the radial opening 441 from the reservoir 443. If desired or necessary, the bottom end 427 in the bottom portion 424 may be closed and water may be removed from the bush cleaning unit 421 through the radial opening 441 or by separating the top portion 423 and the bottom portion 424.

Figure 11:
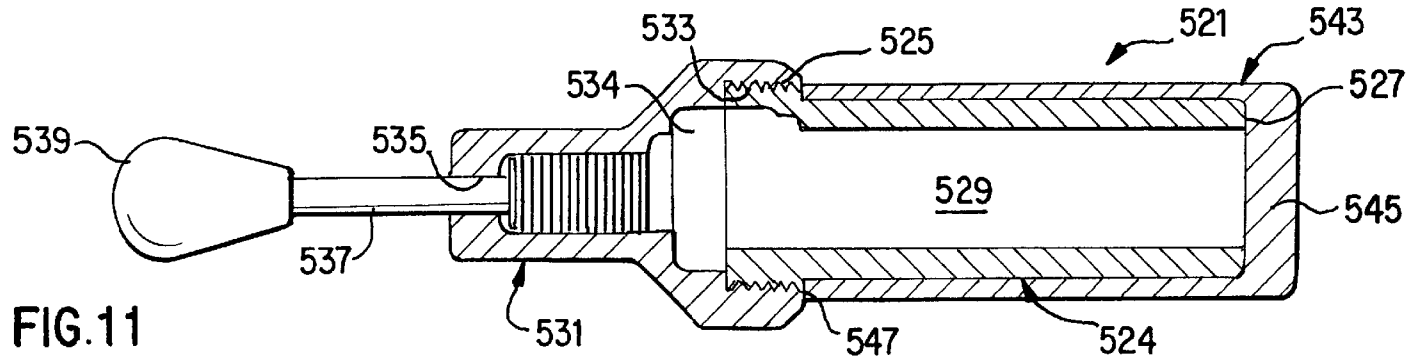
FIG. 11 is a partial cross-sectional side view of a brush cleaning unit according to an embodiment of the present invention.

Another embodiment of the brush cleaning unit 521 is shown in FIG. 11 and is similar to the brush cleaning unit 421 shown in FIG. 10. The brush cleaning unit 521 includes a bottom portion 524 that preferably includes an external thread 525 proximate a top end, a bottom end 527, and an axial opening 529. The axial opening 529 preferably extends the length of the bottom portion 524 and has an asymmetrical shape that corresponds to the asymmetrical shape of the heater element 423 (not shown in FIG. 11) such that the heater element is prevented from rotation relative to the bottom portion. The bottom end 527 of the bottom portion 524 is preferably open.

The brush cleaning unit 521 also includes a top portion 531 having an internal thread 533 for mating with the external thread 525 and having an internal axial opening 534 defining an upper portion of a cavity in which the heater element is disposed. The top portion 531 also has an opening 535 through which a handle 537 of a brush 539 extends such that reciprocation of the brush in the opening causes bristles of the brush to contact the inner surface of the heater element to remove condensates. Preferably the shaft of the handle 537 is non-rotatable relative to the top portion 531, such as by having a non-circular cross-sectional shape, such as a key shape, that slides in a corresponding non-circular opening in the top portion.

In the embodiment shown in FIG. 11, a reservoir 543, which is preferably in the form of a container having an closed top end 545 and an open bottom end 547 and through which water is introduced to the cleaning unit. The reservoir 543 is preferably detachably secured to the bottom portion 524 by any suitable means, such as a threaded connection, a friction fit, or a snap fit. The reservoir 543 is preferably filled with cleaning fluid and then secured to the bottom portion 524.

Figure 12:
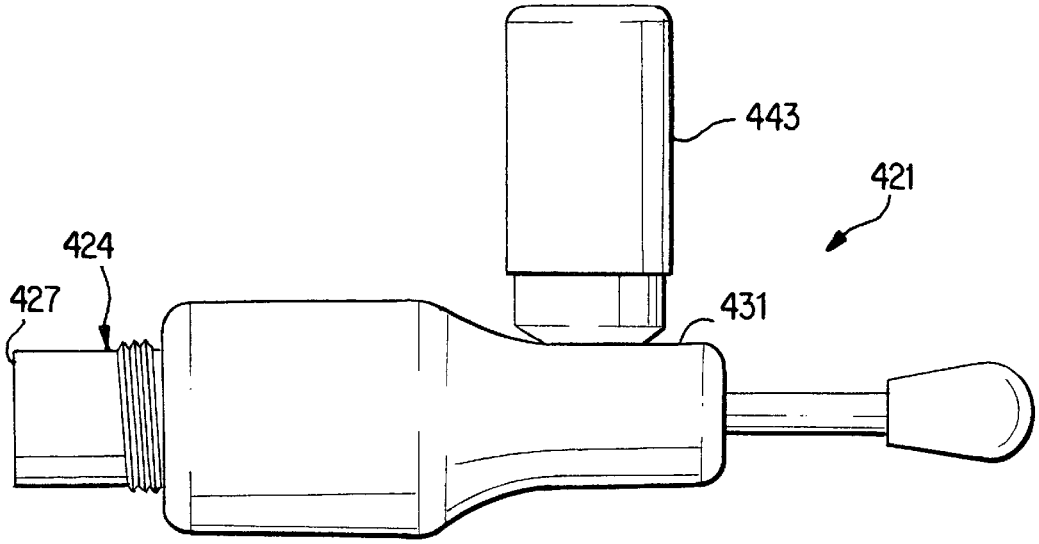
FIG. 12 is a side view of a brush cleaning unit according to an embodiment of the present invention.
Figure 13:
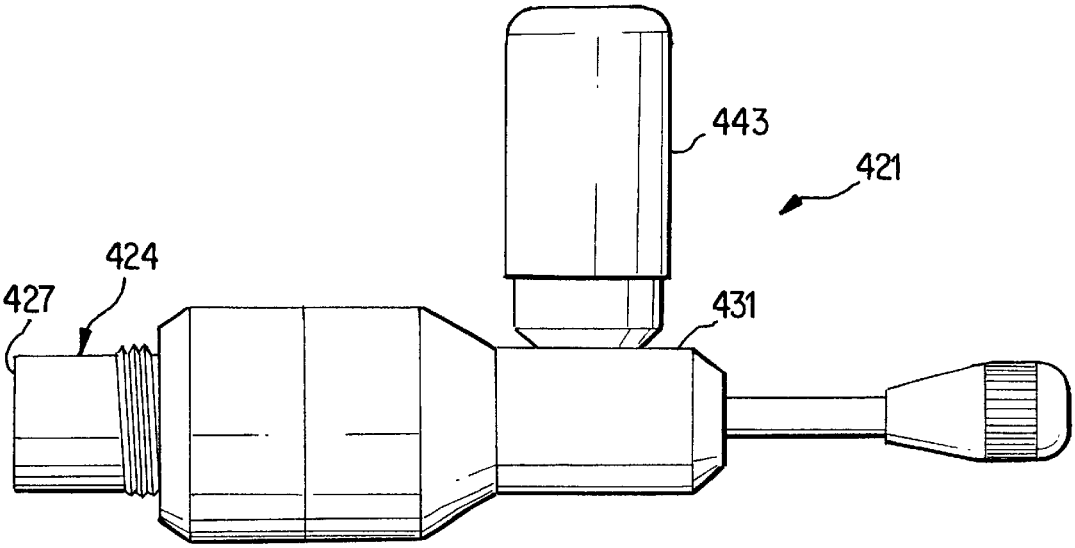
FIG. 13 is a side view of a brush cleaning unit according to an embodiment of the present invention.
Figure 14:
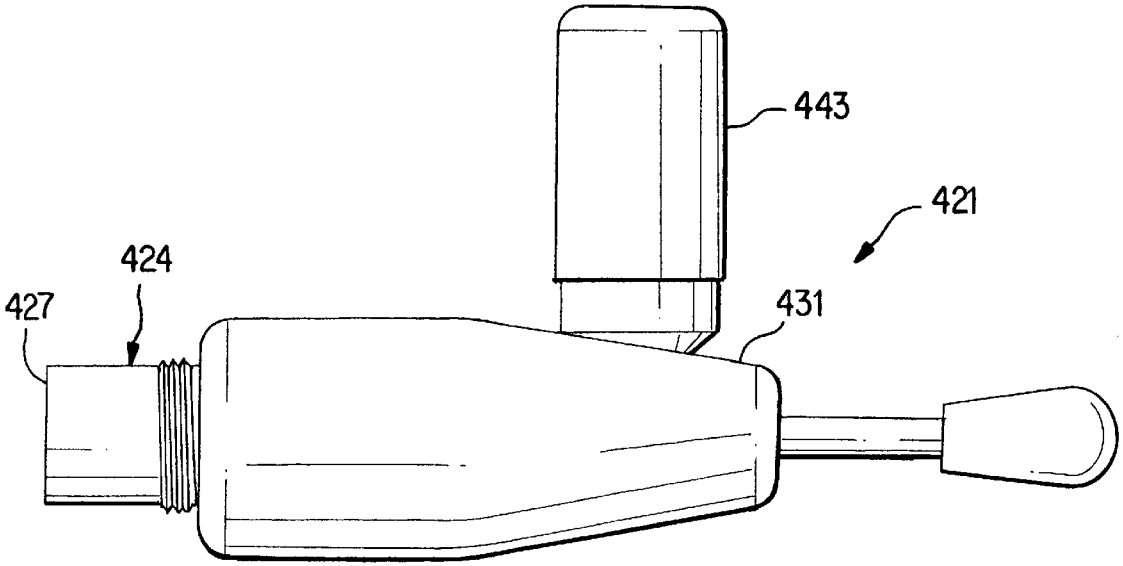
FIG. 14 is a side view of a brush cleaning unit according to an embodiment of the present invention.
Figure 15:
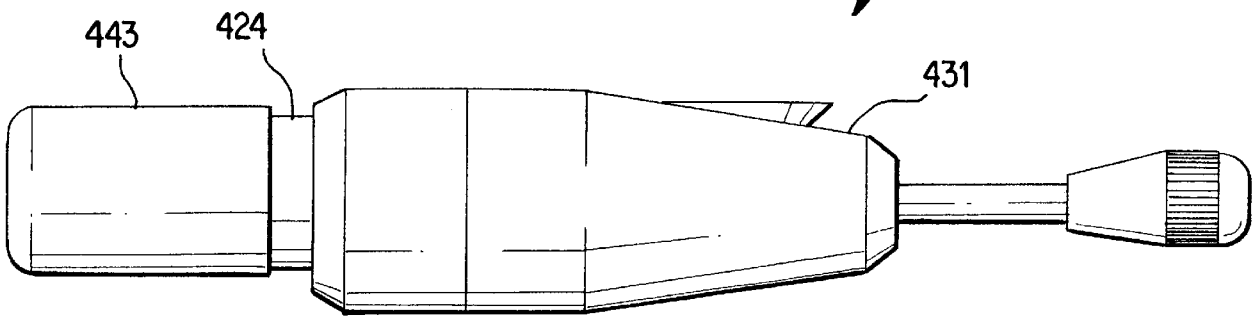
FIG. 15 is a side view of the brush cleaning unit of FIG. 14 showing a container or funnel attached over a bottom portion of the brush cleaning unit.
Figure 16:
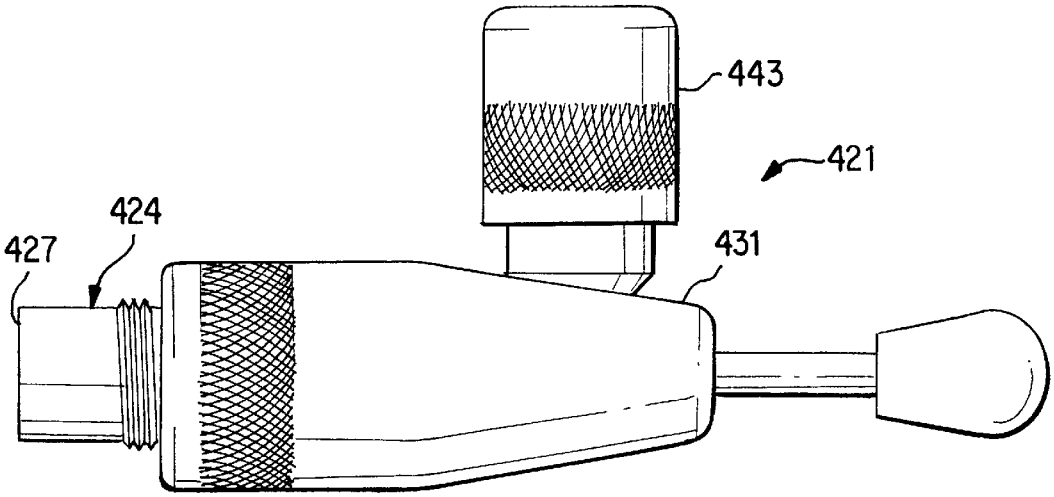
FIG. 16 is a side view of a brush cleaning unit according to an embodiment of the present invention.
Figure 17:
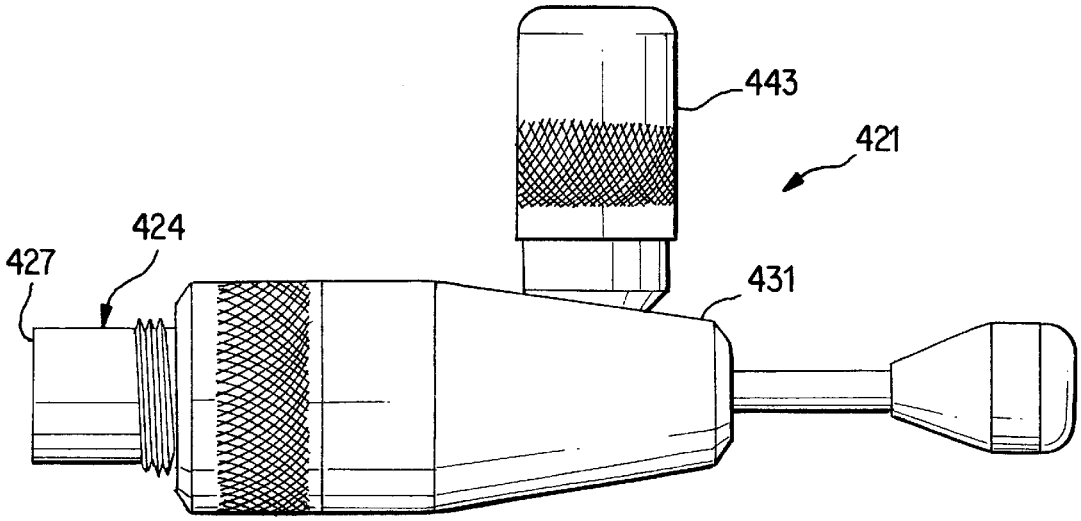
FIG. 17 is a side view of a brush cleaning unit according to an embodiment of the present invention.

FIGS. 12–17 show variations on the embodiment of the cleaning device 421 shown in FIG. 10. In each case, the reservoir 443 is preferably detachable from a radial opening in the top portion 431 after use and attachable over the bottom end 427 of the bottom portion 424, such as by a threaded connection. As seen in FIGS. 12 and 13, for example, which show the same brush cleaning unit set up for operation and set up for storage, respectively, the reservoir 443 is detachable from a radial opening in the top portion 431 and attachable over the bottom end of the bottom portion. It will be appreciated that the embodiments shown in FIGS. 12–17 can be adapted for use in the manner of the embodiment of FIG. 10 by not providing a radial opening in the top portion and closing a top end of the reservoir.

Figure 18:
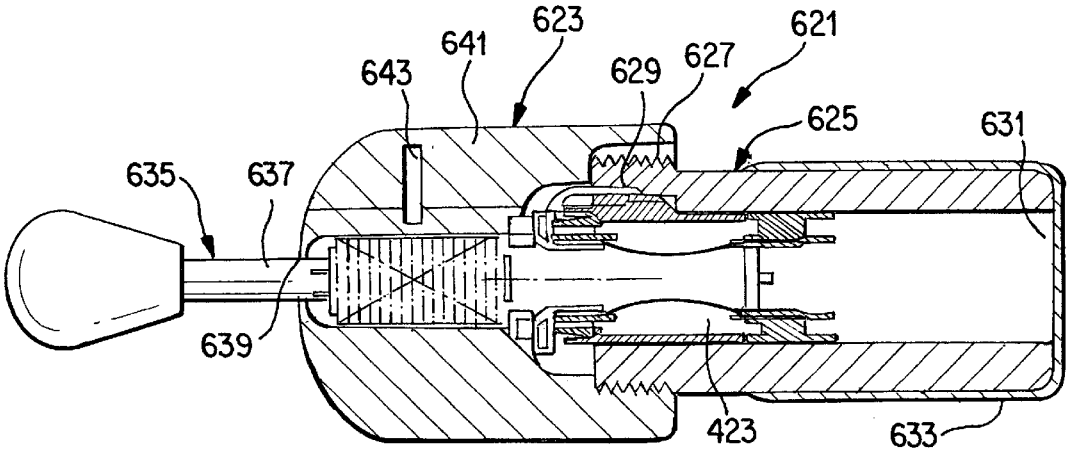
FIG. 18 is a partial cross-sectional side view of a lidded brush cleaning unit according to an embodiment of the present invention, shown with a heater fixture.
Figure 19:
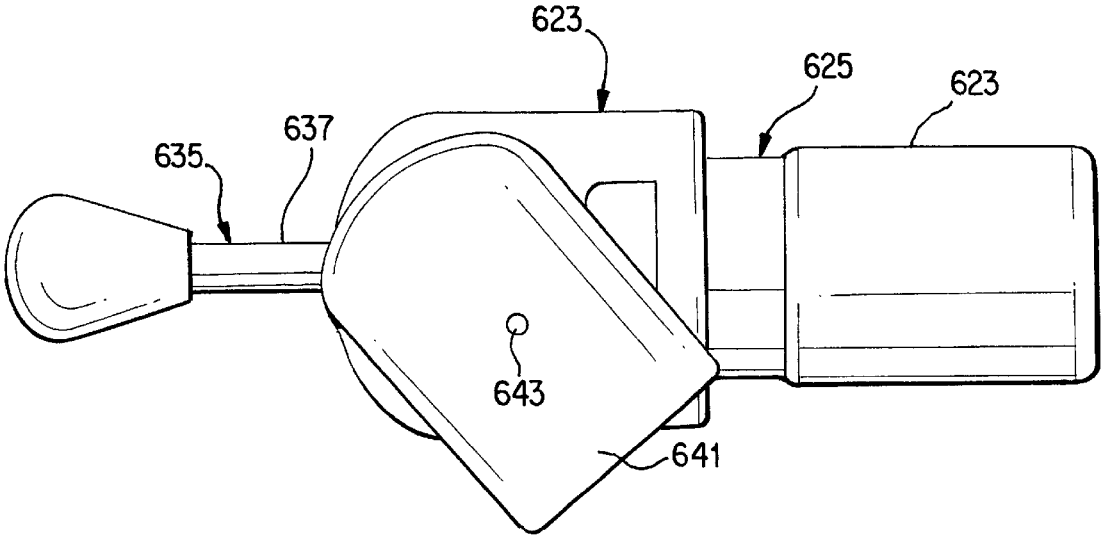
FIG. 19 is a partially cross-sectional side view of a lidded brush cleaning unit taken at section 19—19 of FIG. 18 and shown without the heater fixture.

Another embodiment of the present invention is shown in FIGS. 18 and 19. The cleaning unit 621 includes a top portion 623 and a bottom portion 625. The bottom portion 625 preferably includes an external thread 627 that is adapted to mate with an internal thread 629 of the top portion 623. Together, the top portion 623 and the bottom portion 625 define a cavity of sufficient size to enclose a heater fixture 423. As with the embodiments 421 and 521, the cavity of the embodiment 621 is preferably sized so that the non-circular heater fixture 423 is non-rotatable relative to the cavity. The bottom portion 625 is preferably closed at a bottom end 631 thereof, either by an integral bottom portion or a detachable bottom portion 633, which may be secured to the bottom portion 625 by any suitable means, such as by threads, a snap fit, or a friction fit. The detachable bottom portion 633 facilitates removal of cleaning fluid from the cavity.

The cleaning unit 621 also includes a brush 635 having a shaft 637 that extends through an opening 639 in the top portion 623. The top portion 633 preferably includes a pivotable or removable lid 641. The lid 641 is preferably held in place on the top portion 623 by a pin 643 substantially perpendicular to a plane of the lid and about which the lid is pivotable. The lid 641 is preferably slidable at least a limited distance along the pin 643 to facilitate clearance by the lid of other components of the cleaning unit 621 and the heater fixture 423 during pivoting. The lid 641 may be lockable in a closed position, such as by a snap fit with the pin 643 or by any other suitable means. The lid may also be held in position relative to the top portion 623 by pressure applied by a user's hands. During operation of the cleaning unit 621, cleaning fluid is preferably introduced into the cavity containing the heater fixture through an opening in the top portion that is coverable by the lid 641. The lid 641 is closed over the opening and the brush is reciprocated to clean the heater fixture.

Figure 20:
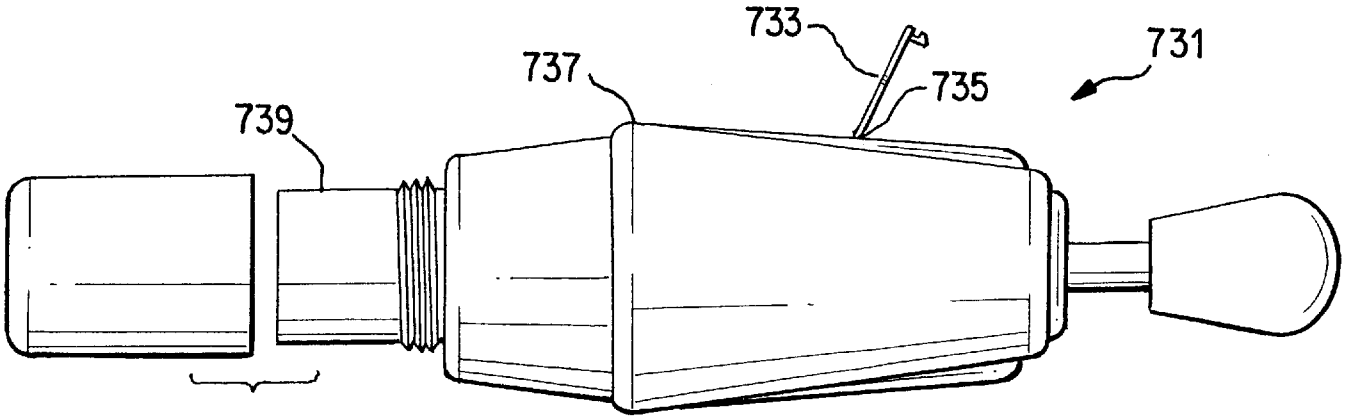
FIG. 20 is a side view of a hinged door brush cleaning unit according to an embodiment of the present invention.
Figure 21:
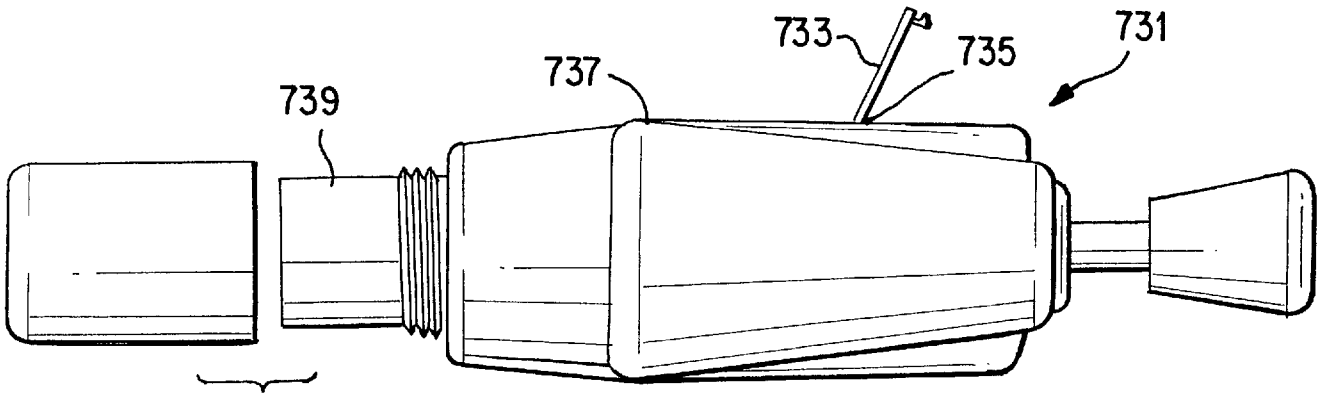
FIG. 21 is a side view of a hinged door brush cleaning unit according to another embodiment of the present invention.

FIGS. 20 and 21 show further embodiments of the cleaning unit 731 according to the present invention. In FIGS. 20 and 21, the cleaning unit 731 is provided with a pivotable lid 733 that pivots about a hinge 735 that is substantially parallel to a plane of the door to permit cleaning fluid to be introduced into the cavity defined by a top portion 737 and a bottom portion 739 that are secured together in the fashion of the other embodiments disclosed herein.

While this invention has been illustrated and described in accordance with a preferred embodiment, it is recognized that variations and changes may be made therein without departing from the invention as set forth in the claims.

What is claimed is:

1. A brush cleaning unit, comprising:

a tube having a first end and a second end, the tube including a portion of a key for cooperating with a corresponding portion of the key on a heater fixture for attaching and orienting the heater fixture relative to the tube, the tube including an opening for ingress and egress of cleaning fluid;

a brush attached to the tube and axially movable relative to the tube and the heater fixture attached thereto, the brush being non-rotatable relative to the tube.

2. The brush cleaning unit as set forth in claim 1, wherein the fluid reservoir includes an open second end.

3. The brush cleaning unit as set forth in claim 1, wherein the fluid reservoir includes a closed second end.

4. The cleaning unit as set forth in claim 1, wherein the heater fixture receiving portion includes a portion of a key for cooperating with a corresponding portion of the key on a heater fixture for attaching and orienting the heater fixture relative to the tube.

5. The cleaning unit as set forth in claim 1, wherein the brush is non-rotatable relative to the tube.

6. A brush cleaning unit, comprising:

a tube having a first end and a second end, the tube including a heater fixture receiving portion, the tube including a radial opening for ingress of cleaning fluid to the tube;

a brush attached to the tube and axially movable relative to the tube; and a fluid reservoir having an open first end detachably connectable to the opening of the tube, the fluid reservoir being detachably connectable to the heater fixture receiving portion.

7. A brush cleaning unit, comprising:

a tube having a first end and a second end, the tube including a heater fixture receiving portion between the first end and the second end, the tube including an axial opening at the second end of the tube in fluid communication with the heater fixture receiving portion;

a brush attached to the first end of the tube and axially movable relative to the tube; and a fluid container having an open first end detachably connectable to the second end of the tube around the axial opening of the tube and a closed second end.

8. A brush cleaning unit, comprising:

a cylinder having a first part and a second part, the first and second parts of the cylinder being detachably connected and defining an internal heater fixture receiving portion;

a brush attached to the first part of the cylinder and axially movable relative to the cylinder; and the first part of the cylinder including a movable door facilitating introduction of cleaning fluid to the heater fixture receiving portion.

9. The cleaning unit according to claim 8, wherein the door is pivotable relative to the cleaning unit about a pivot pin substantially perpendicular to a plane of the door.

10. The cleaning unit according to claim 8, wherein the door is pivotable relative to the cleaning unit about a pivot pin substantially parallel to a plane of the door.

11. A brush cleaning unit for a heater fixture of a smoking device, comprising:

a holder including a wash zone in which a heater fixture of an electrical tobacco smoking device can be located for cleaning thereof with a liquid; and a brush movable within the cavity such that bristles on the brush contact the liquid and remove foreign matter from the heater fixture.

12. The brush cleaning unit of claim 11, wherein the holder includes a slider element which receives the heater fixture, the slider element being movable from a first position at which the heater fixture can be loaded into a cavity in the slidable element located outside of the holder to a second position at which the cavity is located within wash zone of the holder.

13. The brush cleaning unit of claim 11, wherein the slider element includes a locking mechanism which locks the slider element into the holder when the cavity is located within wash zone of the holder.

* * * * *